US006669792B2

(12) United States Patent
Lee et al.

(10) Patent No.: US 6,669,792 B2
(45) Date of Patent: Dec. 30, 2003

(54) PROCESS FOR PRODUCING A CAST ARTICLE FROM A HYPEREUTECTIC ALUMINUM-SILICON ALLOY

(75) Inventors: Jonathan A. Lee, Madison, AL (US); Po-Shou Chen, Huntsville, AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/800,312

(22) Filed: Mar. 2, 2001

(65) Prior Publication Data

US 2001/0010242 A1 Aug. 2, 2001

Related U.S. Application Data

(63) Continuation-in-part of application No. 09/152,469, filed on Sep. 8, 1998, now abandoned.

(51) Int. Cl.[7] ..... C22F 1/04
(52) U.S. Cl. ..... 148/549; 148/700; 148/701
(58) Field of Search ..... 148/549, 700, 148/701

(56) References Cited

U.S. PATENT DOCUMENTS 3,716,355 A * 2/1973 Wikle et al.
4,147,074 A * 4/1979 Noguchi et al.

FOREIGN PATENT DOCUMENTS

| | | | |
|---|---|---|---|
| JP | 61259829 | * | 11/1986 |
| JP | 5230692 | * | 9/1993 |
| JP | 7216487 | * | 8/1995 |
| JP | 8104937 | * | 4/1996 |

OTHER PUBLICATIONS

Mielke, Steffens, Beer, Henning; New Aluminum Piston Alloy with Increased Fatigue Strength at High Temperatures; SAE International The Engineering Society for Advancign Mobility Land Sea Air and Space; Feb. 23–26, 1998; pp. 41–45; 980687; Society of Automotive Engineers, Inc.; Warrendale, Pa, USA.

(List continued on next page.)

*Primary Examiner*—Sikyin Ip
(74) *Attorney, Agent, or Firm*—James J. McGroary; George F. Helfrich

(57) ABSTRACT

A process for making a cast article from an aluminum alloy includes first casting an article from an alloy having the following composition, in weight percent:

| | |
|---|---|
| Silicon (Si) | 14.0–25.0 |
| Copper (Cu) | 5.5–8.0 |
| Iron (Fe) | 0–0.8 |
| Magnesium (Mg) | 0.5–1.5 |
| Nickel (Ni) | 0.05–1.2 |
| Manganese (Mn) | 0–1.0 |
| Titanium (Ti) | 0.05–1.2 |
| Zirconium (Zr) | 0.12–1.2 |
| Vanadium (V) | 0.05–1.2 |
| Zinc (Zn) | 0–0.9 |
| Phosphorus (P) | 0.001–0.1 |
| Aluminum | balance |

In this alloy the ration of Si:Mg is 15–35, and the ratio of Cu:Mg is 4–15. After an article is cast from the alloy, the cast article is aged at a temperature within the range of 400° F. to 500° F. for a time period within the range of four to 16 hours. It has been found especially advantageous if the cast article is first exposed to a solutionizing step prior to the aging step. This solutionizing step is carried out by exposing the cast article to a temperature within the range of 875° F. to 1025° F. for a time period of fifteen minutes to four hours. It has also been found to be especially advantageous if the solutionizing step is followed directly with a quenching step, wherein the cast article is quenched in a quenching medium such as water at a temperature within the range of 120° F. to 300° F. The resulting cast article is highly suitable in a number of high temperature applications, such as heavy-duty pistons for internal combustion engines.

8 Claims, 1 Drawing Sheet

OTHER PUBLICATIONS

J.A. Taylor, G.B. Schaffer, D.H. Stjohn; The Effect of Iron Content on the Formation of Porosityand Shrinkage Defects in Al–Si–Cu–Mg Alloy Casting; Solidification Processing 1997 Proceedings of the 4th Decennial International Conference on Solidification Processing; Jul. 7–10, 1997; Ranmoor House, University of Scheffield, UK.

Hatch, John E.; Constitution of Alloys; Aluminum Properties and Physical Metallurgy; 1984 pp. 25–27; Chapter 2; American Society for Metals; Metals Park, Oh; USA.

Hatch, John E.; Properties and Physical Metallurgy, Specific Alloying Elements and Impurities; Aluminum Properties and Physical Metallurgy; 1984; pp. 224–229; American Society for Metals; Metals Park, Oh; USA.

W. Kowbel, V. Chellappa, J.C. Withers; Applications of Net–Shape Molded Carbon–Carbon Compositeis in IC Engines; Journal of Advanced Materials; Jul. 1996; pp. 2–7; vol. 27 No. 4; USA.

A.J. Shakesheff, P.D. Pitcher; Elevated Temperature Performance of Particulate Reinforced Aluminium Alloys; Materials Science Forum, Proceedings of the 5th International Conf. ICAA5, Jul. 1–5, 1996; pp. 1133–1138; vol. 217–222; 1996 Transtec Publications Switzerland Rohatgi, Pradeep; Cast Aluminum–Matrix Composites for Automotive Applications; JOM the Journal of the Minerals, Metals & Materials Society; Apr. 1991; pp. 10–15.

R.R. Bowles; D.L. Mancini, M.W. Toaz; Metal Matrix Composites Aid Piston Manufacture; CIM Technology, Manufacturing Engineering; May 1987; pp. 61–62.

* cited by examiner

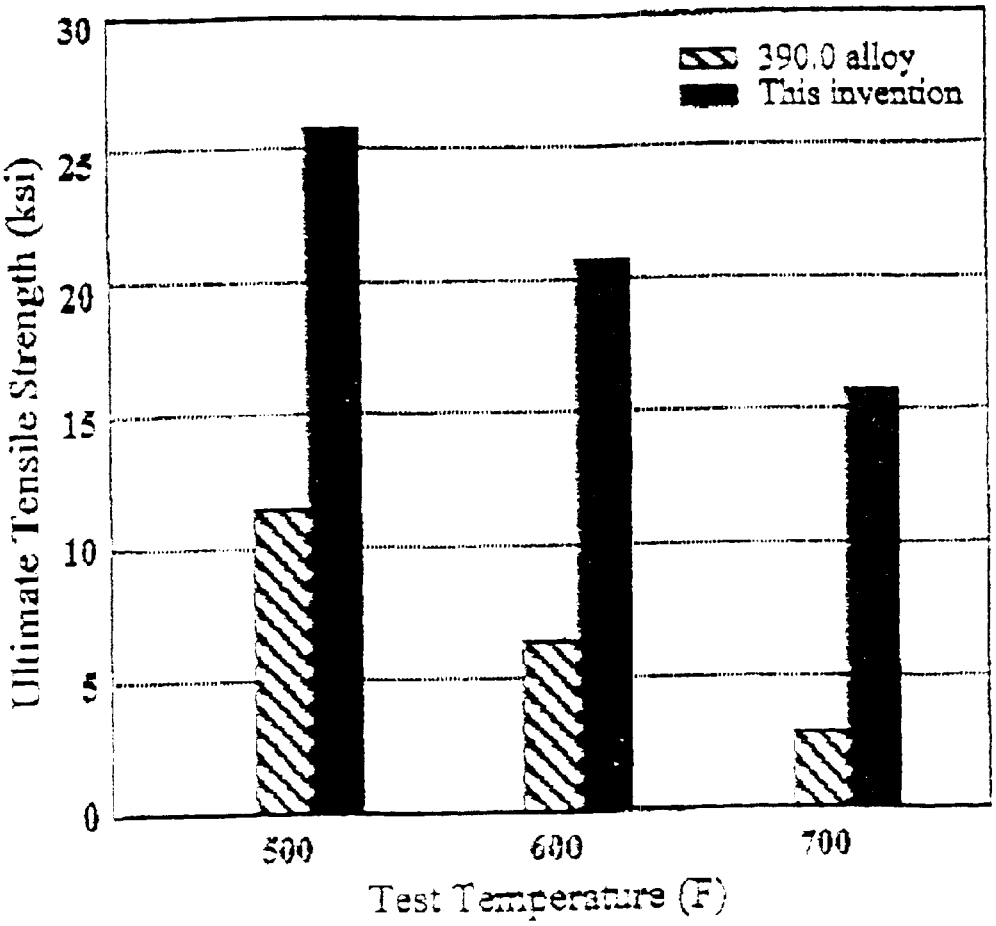
390.0 alloy
This invention
Ultimate Tensile Strength (ksi)
30
25
20
15
10
5
0
500
600
700
Test Temperature (F)

PROCESS FOR PRODUCING A CAST ARTICLE FROM A HYPEREUTECTIC ALUMINUM-SILICON ALLOY

RELATED APPLICATIONS

This application is a continuation-in-part of application Ser. No. 09/152,469 filed Sep. 8, 1998 now abandoned, for Aluminum Alloy Having Improved Properties.

ORIGIN OF THE INVENTION

This invention described herein was made under a NASA contract and is subject to the provisions of Public Law 96-517 (35 USC 202) in which the contractor has elected not to retain title.

BACKGROUND OF THE INVENTION

1. Field of the Invention

This invention relates to aluminum alloys, and specifically to high tensile strength aluminum-silicon (Al—Si) hypereutectic alloy suitable for high temperature applications such as heavy-duty pistons and other internal combustion applications. It relates particularly to a process for producing cast articles from this high tensile strength and high wear resistance Al—Si hypereutectic alloy.

2. Discussion of the Related Art

Al—Si casting alloys are the most versatile of all common foundry cast alloys in the production of pistons for automotive engines. Depending on the Si concentration in weight percent, the Al—Si alloy systems fall into three major categories: hypoeutectic (<12 wt. % Si), eutectic (12–13 wt. % Si) and hypereutectic (14–25 wt. % Si). In hypereutectic alloys, Si plays an important role by enhancing the cast article's surface hardness and wear resistance properties more than hypoeutectic and eutectic alloys. High silicon content in hypereutectic alloys also results in higher elastic modulus and lower thermal expansion. Currently, hypereutectic Al—Si alloys are crucial for high wear resistance applications such as pistons and reciprocate connecting rods. However, conventional hypereutectic alloys, such as 390, are not suitable for high temperature applications, such as in the automotive field, because their mechanical properties, such as tensile strength, are not as high as desired in the temperature range of 500° F.–700° F. Above an elevated service temperature of about 450° F., the major alloy strengthening phases such as the θ' ($Al_2Cu$) and S' ($Al_2CuMg$) will precipitate rapidly, coarsen, or dissolve, and transform themselves into the more stable θ ($Al_2Cu$) and S ($Al_2CuMg$) phases. The undesirable microstructure and phase transformation results in drastically reduced mechanical properties, more particularly the ultimate tensile strength and high cycle fatigue strengths, for hypereutectic Al—Si alloys.

One approach taken by the art is to use ceramic fibers or particulates to increase the strength and improve wear resistance of Al—Si alloys as a substitute for conventional hypereutectic alloys.

This approach is known as the aluminum Metal Matrix Composites (MMC) technology. For example, R. Bowles has used ceramic fibers to improve tensile strength of 332.0 alloy, in a paper entitled, "Metal Matrix Composites Aid Piston Manufacture," *Manufacturing Engineering*, May 1987. Moreover, A. Shakesheff has used ceramic particulates for reinforcing another type of A359 alloy, as described in "Elevated Temperature Performance of Particulate Reinforced Aluminum Alloys," *Materials Science Forum*, Vol. 217–222, pp. 1133–1138 (1996). In a similar approach, cast aluminum MMC for pistons using a eutectic alloy such as the 413.0 type, has been described by P. Rohatgi in a paper entitled, "Cast Aluminum Matrix Composites for Automotive Applications," *Journal of Metals*, April 1991.

Another approach taken by the art is the use of the Ceramic Matrix Composites (CMC) technology in the place of Al—Si alloys. For example, W. Kowbel has described the use of non-metallic carbon—carbon composites for making pistons to operate at high temperatures in a paper entitled, "Application of Net-Shape Molded Carbon—Carbon Composites in IC Engines," *Journal of Advanced Materials*, July 1996. Unfortunately, the material and processing costs of these MMC and CMC technologies are substantially higher than those for conventional casting, and they therefore cannot be considered for large usage in mass production, such as engine pistons.

SUMMARY OF THE INVENTION

A primary object of the present invention is to provide a process for making a cast article from an aluminum alloy, which cast article has improved mechanical properties at elevated temperatures.

According to the present invention, an aluminum alloy having the following composition, by weight percent, is first provided:

| | |
|---|---|
| Silicon (Si) | 14.0–25.0 |
| Copper (Cu) | 5.5–8.0 |
| Iron (Fe) | 0–0.8 |
| Magnesium (Mg) | 0.5–1.5 |
| Nickel (Ni) | 0.05–1.2 |
| Manganese (Mn) | 0–1.0 |
| Titanium (Ti) | 0.05–1.2 |
| Zirconium (Zr) | 0.12–1.2 |
| Vanadium (V) | 0.05–1.2 |
| Zinc (Zn) | 0–0.9 |
| Phosphorus (P) | 0.001–0.1 |
| Aluminum (Al) | balance |

In this aluminum alloy the ratio of Si:Mg is 15–35, preferably 18–28, and the ratio of Cu:Mg is 4–15.

An article is then cast from this composition, and the cast article is aged at a temperature within the range of 400° F. to 500° F. for a time period within the range of four to 16 hours.

In a particularly preferred embodiment, after the article is cast from the alloy, the cast article is first heat treated in a specifically-defined solutionizing step which dissolves unwanted precipitates and reduces any segregation present in the alloy. After this solutionizing step, the cast article is quenched, and is subsequently aged at an elevated temperature for maximum strength.

BRIEF DESCRIPTION OF THE DRAWING

The sole FIGURE of the Drawing is a chart showing a comparison of a cast article prepared according to the process of the present invention with cast article from a prepared well-known hypereutectic (390.0) commercial alloy in a standard process. The chart compares ultimate tensile strengths (tested at 500° F., 600° F., and 700° F.), after exposure of the cast articles to a temperature of 500° F., 600° F., and 700° F., respectively, for 100 hours.

DETAILED DESCRIPTION OF THE INVENTION

The Al—Si alloy employed in the present invention is unexpectedly marked by a superior ability to perform in cast form at elevated temperatures when produced by the process according to the present invention. The Al—Si alloy employed in the present invention is composed of the following elements, by weight percent (wt. %):

| | |
|---|---|
| Silicon (Si) | 14.0–25.0 |
| Copper (Cu) | 5.5–8.0 |
| Iron (Fe) | 0–0.8 |
| Magnesium (Mg) | 0.5–1.5 |
| Nickel (Ni) | 0.05–1.2 |
| Manganese (Mn) | 0–1.0 |
| Titanium (Ti) | 0.05–1.2 |
| Zirconium (Zr) | 0.12–1.2 |
| Vanadium (V) | 0.05–1.2 |
| Zinc (Zn) | 0–0.9 |
| Phosphorus (P) | 0.001–0.1 |
| Aluminum (Al) | balance |

In this alloy the ratio of Si:Mg is 15–35; preferably 18–28; and the ratio of Cu:Mg is 4–15.

Iron, manganese, and zinc may be omitted from the alloy employed in the process according to the present invention. However, these elements tend to exist as impurities in most aluminum alloys, as a result of common foundry practices. Eliminating them completely from the alloy (i.e., by alloy refining techniques) increases the cost of the product significantly.

Silicon gives the hypereutectic alloy a high elastic modulus and low thermal expansion. At a level of greater than 15%, silicon provides excellent surface hardness and wear resistance properties. However, the primary crystals of Si must be distributed uniformly and refined, using phosphorus, in order to achieve a superior hardness and good wear resistance properties.

Copper co-exists with magnesium and forms a solid solution in the aluminum matrix to give the alloy age-hardening properties, thereby improving the high temperature strength. Copper also forms the θ' phase compound ($Al_2Cu$), and is the most potent strengthening element in this alloy. The enhanced high strength at high temperatures will be adversely affected if the copper wt. % level is not adhered to.

Moreover, the alloy strength can only be maximized effectively by the simultaneous formation of both of the θ' ($Al_2Cu$) and S' ($Al_2CuMg$) metallic compounds, using proper addition of magnesium into the alloy, relative to the element of copper and silicon. Experimentally, it is found that an alloy with a significantly high level of magnesium will form mostly S' phase with an insufficient amount of θ' phase. On the other hand, an alloy with a lower level of magnesium contains mostly θ' phase, with insufficient amount of S' phase. To maximize the formation of both the θ' and S' phases, the alloy composition is specifically formulated with copper-to-magnesium ratios ranging from 4 to 15, with a minimum value for magnesium of no less than 0.5 wt. %. In addition to the Cu/Mg ratio, the silicon-to-magnesium ratio should be kept in the range of 15 to 35, preferably 18 to 28, to properly form the $Mg_2Si$ metallic compound as a minor strengthening phase, in addition to the primary θ' and S' phases.

Titanium and vanadium form primary crystals of Al—Ti and Al—V metallic compounds, and these crystallized compounds act as nuclei for grain size refinement upon the molten alloy being solidified from the casting process. Titanium and vanadium also function as dispersion strengthening agents, in order to improve the high temperature mechanical properties.

Zirconium forms primary crystals of Al—Zr compounds. These crystallized intermetallic compounds also act as particles for dispersion strengthening. Zirconium also forms a solid solution in the matrix to a small amount, thus enhancing the formation of GP (Guinier-Preston) zones, which are the Cu—Mg rich regions, and the θ' phase in the Al—Cu—Mg system, to improve the age-hardening properties.

Nickel improves the alloy tensile strength at elevated temperatures by reacting with aluminum to form the $Al_3Ni_2$ and $Al_3Ni$ compounds, which are stable metallurgical phases, to resist degradation effects from long-term exposure to high temperature environments.

Phosphorus is used to modify the Al—Si eutectic phase, and most importantly the primary crystals of Silicon. The hardness and wear resistance of a hypereutectic alloy are substantially improved with finer Si grains by using phosphorus. Effective modification is achieved at a very low additional level, but the range of recovered phosphorus of 0.001 to 0.1 wt. % is satisfactorily employed.

The alloy employed in the process according to this invention is processed according to the present invention using conventional gravity casting in the temperature range of about 1325° F. to 1450° F., without the aid of pressure such as squeeze casting, pressure casting or die casting, to achieve dramatic and unexpected improvement in tensile strengths at 500° F. to 700° F. However, it is anticipated that further improvement of tensile strengths will be obtained when the alloy employed in this invention is cast using pressure casting techniques such as squeeze casting or die-casting.

According to the present invention, an article, such as an engine block or a piston, is cast from the alloy, and the cast article is then solutionized at a temperature of 875° F. to 1025° F., preferably 900° F. to 1000° F., for fifteen minutes to four hours. The purpose of solutionizing is to dissolve unwanted precipitates and reduce any segregation present in the alloy. For applications of the cast article at temperatures from 500° F. to 700° F. the solutioning treatment may not be required.

After solutionizing, the article is advantageously quenched in a quenching medium, at a temperature within the range of 120° F. to 300° F., most preferably 170° F. to 250° F. The most preferred quenching medium is water. After quenching, the article is aged at a temperature of 400° F. to 500° F., preferably 425° F. to 485° F. for four to 16, preferably six to 12 hours.

Table 1 below shows ultimate tensile strength, yield strength and fatigue strength at tested temperatures for an article produced according to the process of the present invention, which has been exposed to test temperatures of 500° F., 600° F., and 700° F. for 100 hours. The fatigue test is a push-pull, completely reversed stress cycle, R-1. This is the most severe type of fatigue testing. Table 1 also shows the hardness as measured at room temperature (Rockwell B scale) for an article produced according to the process of the present invention, which has been exposed to 500° F., 600° F., and 700° F. for 100 hours.

TABLE 1

| Temperature (° F.) | Ultimate Tensile Strength (ksi) | Yield Strength (ksi) | Fatigue Strength (ksi) at 10 million cycles | Hardness (Rockwell B Scale) |
|---|---|---|---|---|
| 75 | 38 | 33 | 17 | 71 |
| 400 | 31 | 30 | 13 | 64 |

TABLE 1-continued

| Temperature (° F.) | Ultimate Tensile Strength (ksi) | Yield Strength (ksi) | Fatigue Strength (ksi) at 10 million cycles | Hardness (Rockwell B Scale) |
|---|---|---|---|---|
| 500 | 26 | 20 | 10 | 55 |
| 600 | 21 | 17 | 9 | 50 |
| 700 | 16 | 12 | 7 | 33 |

Table 2 below illustrates the dramatic improvement in the ultimate tensile strength at elevated temperatures for an article produced according to the present invention. This table compares the tensile strengths of articles produced according to this invention, with articles prepared by standard processing from a well-known hypereutectic alloy (390.0), after articles cast from these alloys had been exposed to 500° F., 600° F., and 700° F. for 100 hours. The articles were then tested at elevated temperatures of 500° F., 600° F., and 700° F., respectively. It is noted that the tensile strength of an article produced according to this invention is more than three times that of an article produced by standard techniques employing a conventional hypereutectic (390.0), when tested at 700° F. Such a dramatic improvement in tensile strength enables the design and production of new pistons, which achieve better engine performance while utilizing less material. By using less material, piston weight and the production costs are also reduced significantly.

In recent years, increasingly stringent exhaust emission regulations for internal combustion engines have forced piston designers to reduce the piston's crevice volume (the space between the piston top-land and the cylinder bore) by moving the piston ring closer to the top of the piston. Such piston design modifications reduce exhaust emissions, but require a stronger cast alloy to prevent failure of the piston top-land, due to high mechanical cyclic loading at elevated temperatures. Unfortunately, most commercially available pistons are unable to meet a constant demand for higher strength at elevated temperatures of above 500° F. Indeed, the dramatic improvement in strength, which is provided by an article produced according to the present invention, is a most significant factor that will enable gasoline and diesel pistons to meet exhaust emission standards and to achieve better engine performance.

Articles produced from conventional hypoeutectic and eutectic alloys by processes of the art undergo dimensional changes when they are exposed to high temperature after heat treatment. In most cases, an increase in volume of the cast part is to be found, and these volume changes are commonly called thermal growth. It will be noted also that the thermal growth stability of products prepared according to this invention is better than conventional Al—Si products at elevated temperatures, when tested under the same operating conditions. Currently, all standard eutectic products show the material thermal growth in the piston top-land area, which causes a deformation problem for the piston skirt. Articles produced according to this invention have a significantly less material thermal growth to maintain optimum clearances of both the piston skirt and ring lands to the cylinder wall, thus preventing piston noise and enhancing durability and oil consumption. In addition to better mechanical properties, the lower thermal growth of articles prepared according to this invention is a favorable factor for the making of high performance gasoline and diesel pistons.

TABLE 2

| Cast Article | UTS at 500° F. (ksi) | UTS at 600° F. (ksi) | UTS at 700° F. (ksi) |
|---|---|---|---|
| Prepared according to this invention | 26 | 21 | 16 |
| Prepared using 390.0 (hypereutectic) | 12 | 7 | 3.5 |

We claim:

1. A process for making a cast article from an aluminum alloy, which article has improved mechanical properties at elevated temperatures, the process comprising:

a. Casting an article from an aluminum alloy having the following composition in weight percent:

| | |
|---|---|
| Silicon | 14.0–25.0 |
| Copper | 5.5–8.0 |
| Iron | 0–0.8 |
| Magnesium | 0.5–1.5 |
| Nickel | 0.05–1.2 |
| Manganese | 0–1.0 |
| Titanium | 0.05–1.2 |
| Zirconium | 0.12–1.2 |
| Vanadium | 0.05–1.2 |
| Zinc | 0–0.9 |
| Phosphorus | 0.001–0.1 |
| Aluminum | balance, |

wherein the ratio of silicon:magnesium in the aluminum alloy is 15–35, and the ratio of copper:magnesium in the aluminum alloy is 4–15, b. Aging the cast article at a temperature within the range of 400° F. to 500° F. for a time period within the range of four to 16 hours.

2. The process of claim 1, wherein the article is exposed to a solutionizing step prior to the aging step, the solutionizing step being carried out by exposing the cast article to a temperature within the range of 875° F. to 1025° F., for a time period of fifteen minutes to four hours.

3. The process of claim 1, wherein the cast article is aged at a temperature within the range of 425° F. to 485° F. for six to 12 hours.

4. The process of claim 2, wherein the solutionizing step is immediately followed by a quenching step, wherein the article is quenched in a quenching medium at a temperature within the range of 120° F. to 300° F.

5. The process of claim 4, wherein the temperature of the quenching medium is within the range of 170° F. to 250° F.

6. The process of claim 5 wherein the quenching medium is water.

7. The process of claim 1, wherein the article is cast from the aluminum alloy by gravity casting without the aid of pressure, in the temperature range of about 1325° F. to 1450° F.

8. The process of claim 2, wherein the cast article is exposed to a temperature within the range of 900° F. to 1000° F.

* * * * *